US009798276B2

(12) United States Patent
Ono

(10) Patent No.: US 9,798,276 B2
(45) Date of Patent: Oct. 24, 2017

(54) IMAGE FORMING APPARATUS

(71) Applicant: CANON KABUSHIKI KAISHA, Tokyo (JP)

(72) Inventor: Kazuaki Ono, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/188,752

(22) Filed: Jun. 21, 2016

(65) Prior Publication Data

US 2016/0378058 A1 Dec. 29, 2016

(30) Foreign Application Priority Data

Jun. 26, 2015 (JP) ..... 2015-128204

(51) Int. Cl.

| | |
|---|---|
| ***G03G 15/00*** | (2006.01) |
| ***G03G 15/20*** | (2006.01) |
| ***G03G 15/02*** | (2006.01) |
| *G03G 21/00* | (2006.01) |

(52) U.S. Cl.

CPC ..... *G03G 15/2025* (2013.01); *G03G 15/0225* (2013.01); *G03G 21/0052* (2013.01); *G03G 2221/1645* (2013.01)

(58) Field of Classification Search

CPC ..... G03G 21/206; G03G 2221/1645; G03G 15/0225; G03G 15/0258; G03G 15/2025; G03G 15/052; G03G 15/2075; G03G 2221/0052

See application file for complete search history.

(56) References Cited

U.S. PATENT DOCUMENTS

| | | | | |
|---|---|---|---|---|
| 6,397,030 | B1 * | 5/2002 | Watanabe | G03G 15/161 399/237 |
| 2005/0238379 | A1 * | 10/2005 | Ogane | G03G 15/0258 399/92 |
| 2006/0117771 | A1 * | 6/2006 | Fujimori | G03G 21/203 62/176.1 |
| 2006/0275048 | A1 * | 12/2006 | Nishimura | G03G 15/0258 399/92 |
| 2007/0110468 | A1 * | 5/2007 | Shimazu | G03G 15/0258 399/92 |
| 2007/0217841 | A1 * | 9/2007 | Fujii | G03G 15/2039 399/341 |
| 2008/0199208 | A1 * | 8/2008 | Schlitz | G03G 15/0258 399/100 |
| 2009/0263163 | A1 * | 10/2009 | Sandler | G03G 15/161 399/249 |
| 2010/0303522 | A1 * | 12/2010 | Kodama | G03G 21/206 399/323 |
| 2011/0091249 | A1 * | 4/2011 | Murakami | G03G 15/6573 399/323 |

(Continued)

FOREIGN PATENT DOCUMENTS

JP 2007-79411 A 3/2007

*Primary Examiner* — Clayton E Laballe
*Assistant Examiner* — Ruifeng Pu
(74) *Attorney, Agent, or Firm* — Canon USA, Inc. I.P. Division

(57) ABSTRACT

The present invention includes a compressor for generating compressed air for separating a sheet from a fixing portion. By using the compressed air generated by the compressor, an image forming portion, more specifically, for example, a charger, is cleaned.

10 Claims, 12 Drawing Sheets

(56) References Cited

U.S. PATENT DOCUMENTS

| | | | | |
|---|---|---|---|---|
| 2011/0182609 | A1* | 7/2011 | Hasegawa | G03G 15/2028 399/94 |
| 2011/0206425 | A1* | 8/2011 | Seto | G03G 15/2039 399/323 |
| 2011/0222897 | A1* | 9/2011 | Makino | G03G 15/0258 399/92 |
| 2012/0027476 | A1* | 2/2012 | Tanaka | G03G 15/2028 399/323 |
| 2012/0045260 | A1* | 2/2012 | Yamamoto | G03G 15/2028 399/323 |
| 2012/0051804 | A1* | 3/2012 | Takeshita | G03G 15/2028 399/323 |
| 2012/0201563 | A1* | 8/2012 | Miyazawa | G03G 15/0258 399/92 |
| 2012/0213533 | A1* | 8/2012 | Yamamoto | G03G 15/2028 399/21 |
| 2014/0044448 | A1* | 2/2014 | Fukuda | G03G 15/0258 399/100 |
| 2014/0186069 | A1* | 7/2014 | Nogami | G03G 15/0291 399/93 |
| 2015/0261182 | A1* | 9/2015 | Katsumata | G03G 15/02 399/92 |

* cited by examiner

IMAGE FORMING APPARATUS

BACKGROUND OF THE INVENTION

Field of the Invention

The present invention relates to an image forming apparatus that forms a toner image on a sheet.

Description of the Related Art

In an image forming apparatus disclosed in Japanese Patent Laid-Open No. 2007-79411, a recording medium (sheet) is separated from a fixing device by compressed air blown to the fixing device. This is to inhibit recording media having low hardness, such as thin paper, from being wrapped around the fixing device.

Hence, a compressor for generating compressed air is used.

Because compressors are expensive, they are required to be more effectively used in image forming apparatuses.

SUMMARY OF THE INVENTION

According to an aspect of the present invention, there is provided an image forming apparatus comprising: an image forming portion configured to form a toner image on a sheet; a fixing portion configured to fix the toner image on the sheet; a compressor configured to generate compressed air; a first blower configured to blow the compressed air to said fixing portion to separate the sheet from said fixing portion; and a second blower configured to blow the compressed air to said image forming portion to clean said image forming portion.

According to another aspect of the present invention, there is provided an image forming apparatus comprising: a photosensitive member; a charging portion configured to electrically charge said photosensitive member; an exposing portion configured to expose said photosensitive member charged by said charging portion to form an electric image; a developing portion configured to develop the electric image by toner to form a toner image; a transferring portion configured to transfer the toner image to a sheet; a fixing portion configured to fix the toner image on the sheet; a compressor configured to generate compressed air; a first blower configured to blow the compressed air to said fixing portion to separate the sheet from said fixing portion; and a second blower configured to blow the compressed air to said charging portion to clean said charging portion.

Further features of the present invention will become apparent from the following description of exemplary embodiments with reference to the attached drawings.

DESCRIPTION OF THE EMBODIMENTS

First Embodiment

A first embodiment of the present invention will be described below with reference to FIGS. 1 to 10A and 10B.

Image Forming Apparatus

Figure 1:
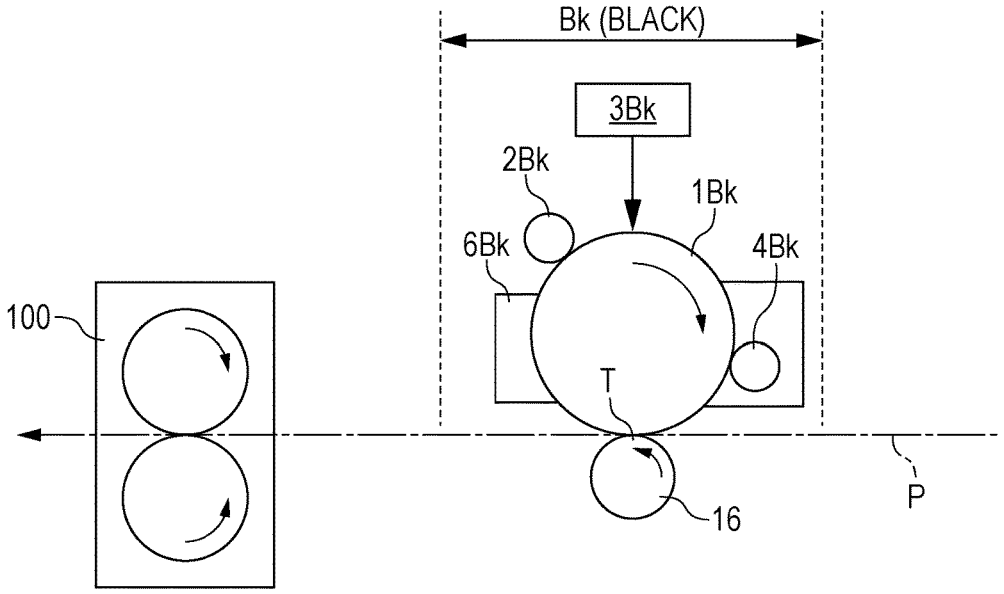
FIG. 1 is a schematic diagram showing the configuration of a monochrome image forming apparatus.

First, referring to FIGS. 1 and 2, a monochrome and a color image forming apparatus according to this embodiment will be described. The monochrome image forming apparatus shown in FIG. 1 has an image forming unit for forming a black toner image. A cylindrical electrophotographic photosensitive member (hereinbelow referred to as "photosensitive drum") 1Bk, serving as an image-bearing member and having a surface layer formed of, for example, an organic photoconductor (OPC), is rotationally driven in the direction indicated by the arrow. A charging roller 2Bk uniformly and evenly charges the surface of the photosensitive drum 1Bk. The charging roller 2Bk supplied with a predetermined bias is in contact with and rotated in a driven manner by the photosensitive drum 1Bk, thus charging the surface of the photosensitive drum 1Bk to a predetermined electric potential.

The charged photosensitive drum 1Bk is exposed to exposure light (laser light or the like) by an exposure device 3Bk, and, as a result, an electrostatic latent image corresponding to an input source document is formed thereon. A developing device 4Bk develops, by using a developing roller, the electrostatic latent image with charged toner, forming a toner image corresponding to the electrostatic latent image on the surface of the photosensitive drum 1Bk. The toner image on the photosensitive drum 1Bk is transferred to a recording medium P at a transfer portion T between the photosensitive drum 1Bk and the transfer roller 16.

The transfer residual toner remaining on the photosensitive drum 1Bk after transfer is collected by a photosensitive-drum cleaning device 6Bk having a blade, brush, or the like. Then, the photosensitive drum 1Bk from which the transfer residual toner has been removed is uniformly and evenly charged again by the charging roller 2Bk and is repeatedly used for image formation.

The image (toner image) formed on the recording medium P by this image forming portion as described above is fixed onto the recording medium P by a fixing device 100. Specifically, the recording medium (sheet) P having the toner image transferred thereto is guided into the fixing device 100 and is subjected to pressure and heat. Thus, the toner image is fixed onto the recording medium P, and a monochrome image is obtained.

Figure 2:
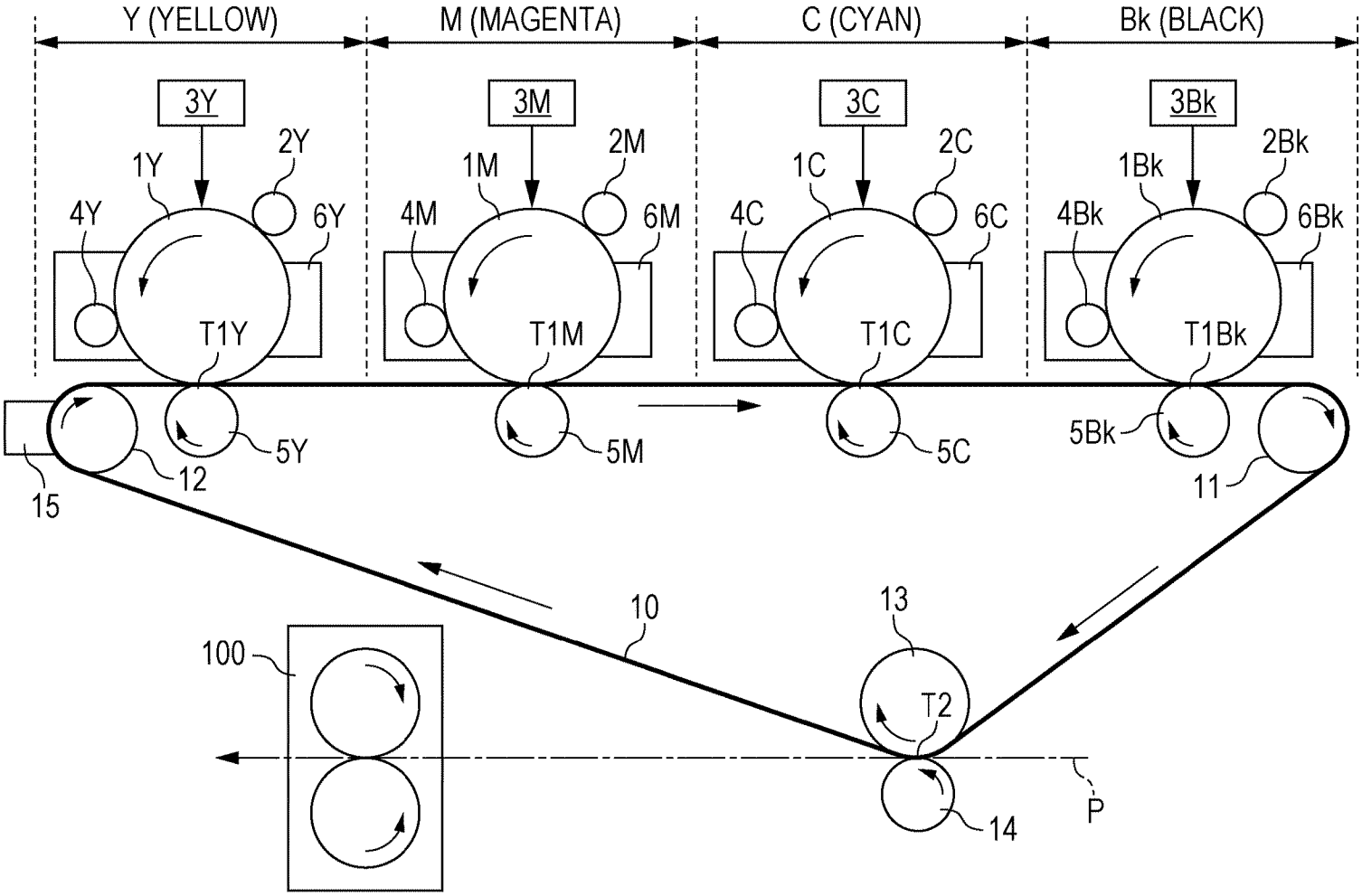
FIG. 2 is a schematic diagram showing the configuration of a color image forming apparatus.
Figure 3A:
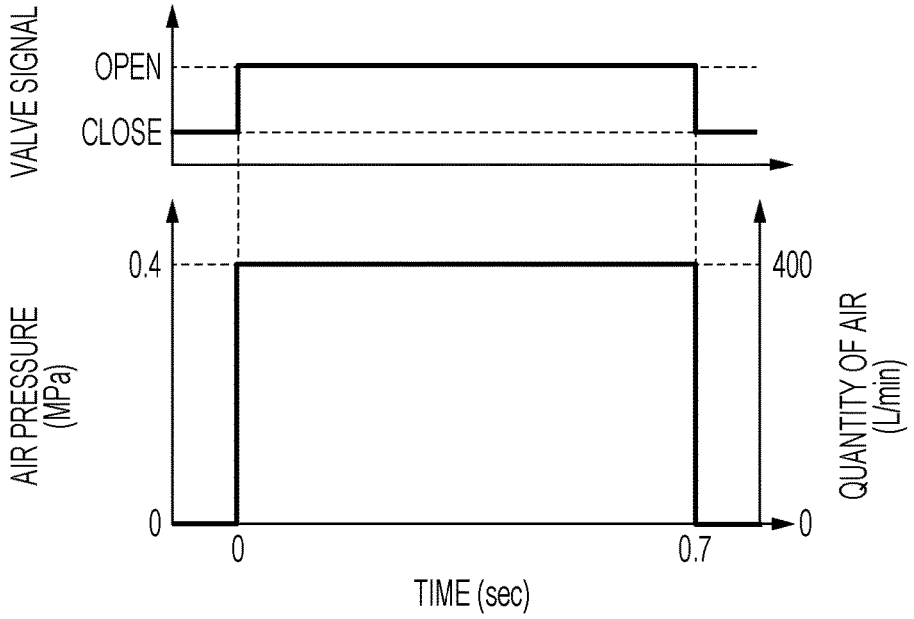
FIGS. 3A and 3B schematically show changes, with time, in the air pressure and the quantity of air in a compressed-air blowing device with and without an air tank, respectively.
Figure 3B:
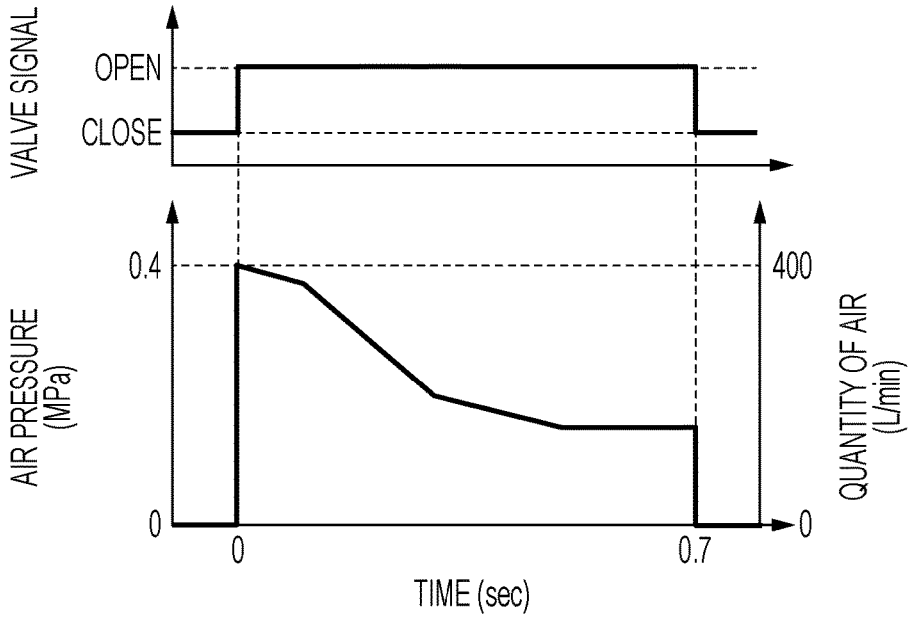

A color image forming apparatus as shown in FIG. 2 has four image forming units Y (yellow), M (magenta), C (cyan), and Bk (black) that form four different color toner images. An endless intermediate transfer belt 10, serving as an intermediate transfer member, is provided so as to traverse these image forming units.

These four image forming units Y, M, C, and Bk have the same configuration. Hence, the configuration of the image forming unit Y, which form a yellow toner image, will be described below as a representative example. The components of the other image forming units having the same configurations and functions as the corresponding component of the image forming unit Y will be denoted by the same numbers as those of the image forming unit Y, and the letters suffixed to them, indicating the respective units, are changed.

A cylindrical electrophotographic photosensitive member (hereinbelow referred to as a "photosensitive drum") 1Y, serving as an image-bearing member and having a surface layer formed of, for example, OPC, is rotationally driven in the direction indicated by the arrow. A charging roller 2Y uniformly and evenly charges the surface of the photosensitive drum 1Y. The charging roller 2Y supplied with a predetermined bias is in contact with and rotated in a driven manner by the photosensitive drum 1Y, thus charging the surface of the photosensitive drum 1Y to a predetermined electric potential. The charged photosensitive drum 1Y is exposed to exposure light (laser light or the like) by the exposure device 3Y, and, as a result, an electrostatic latent image corresponding to a color-separated image of the input source document is formed. A developing device 4Y develops, by using a developing roller, the electrostatic latent image with charged toner, forming a toner image corresponding to the electrostatic latent image on the surface of the photosensitive drum 1Y.

The toner image on the photosensitive drum 1Y is primary-transferred, by a primary transfer roller 5Y, to the intermediate transfer belt 10, which revolves at substantially the same speed as the circumferential speed of the photosensitive drum 1Y at a primary transfer portion T1Y between the photosensitive drum 1Y and the primary transfer roller 5Y.

The primary-transfer residual toner remaining on the photosensitive drum 1Y after the primary transfer is collected by a photosensitive-drum cleaning device 6Y having a blade, brush, or the like. Then, the photosensitive drum 1Y from which the primary-transfer residual toner has been removed is uniformly and evenly charged again by the charging roller 2Y and is repeatedly used for image formation.

The intermediate transfer belt 10 is stretched over a driving roller 11, a support roller 12, and a backup roller 13. The intermediate transfer belt 10 is revolved by the rotation of the driving roller 11 in the direction indicated by the arrow, while being in contact with the photosensitive drums 1Y, 1M, 1C, and 1Bk of the four image forming units Y, M, C, and Bk.

When a full-color mode (full-color image formation) is selected, the above-described image forming operation is performed in each of the four image forming units Y, M, C, and Bk. Then, a yellow toner image, a magenta toner image, a cyan toner image, and a black toner image formed on the photosensitive drums 1Y, 1M, 1C, and 1Bk, respectively, are sequentially transferred to the intermediate transfer belt 10 in a superposed manner. Note that the order of the colors is not limited to the aforementioned order and may be arbitrarily set according to the image forming apparatus.

The four color toner images transferred in a superposed manner to the intermediate transfer belt 10 are together secondary-transferred to a recording medium P by a secondary transfer roller 14, at a secondary transfer portion T2 between the backup roller 13 and the secondary transfer roller 14. The recording medium P is fed from a sheet feed cassette (not shown) and is fed to the secondary transfer portion T2 by a registration roller pair (not shown), at predetermined control timing in accordance with the delivery of the superposed toner images on the intermediate transfer belt 10.

In this embodiment, the image forming portion that forms a toner image on a recording medium (sheet) P is configured as above. Specifically, the image forming portion includes a plurality of devices that serve a function to form a toner image on a sheet. The toner image that has been formed on a recording medium P by this image forming portion is fixed to the recording medium P by the fixing device 100, serving as the fixing portion. Specifically, a recording medium P having a toner image transferred thereto is guided into the fixing device 100 and is subjected to pressure and heat. As a result, a full-color toner image is fixed to the recording medium P.

The secondary-transfer residual toner remaining on the intermediate transfer belt 10 after the secondary transfer is collected by an intermediate transfer cleaning device 15 having a blade, brush, or the like. Then, the intermediate transfer belt 10 from which the secondary-transfer residual toner has been removed is repeatedly used for primary transfer in image formation.

When, for example, a mono-color mode (mono-color image formation) in which only black is used or a mode in which two to three colors are used, image formation is performed on the photosensitive drums in the image forming units that are to be used. At this time, the photosensitive drums in the image forming units that are not used are idly rotated. Then, the toner images are primary-transferred to the intermediate transfer belt 10 at the primary transfer portion T1 and are secondary-transferred to a recording medium P at the secondary transfer portion T2. Then, the recording medium P is guided into the fixing device 100.

Fixing Device

Figure 4:
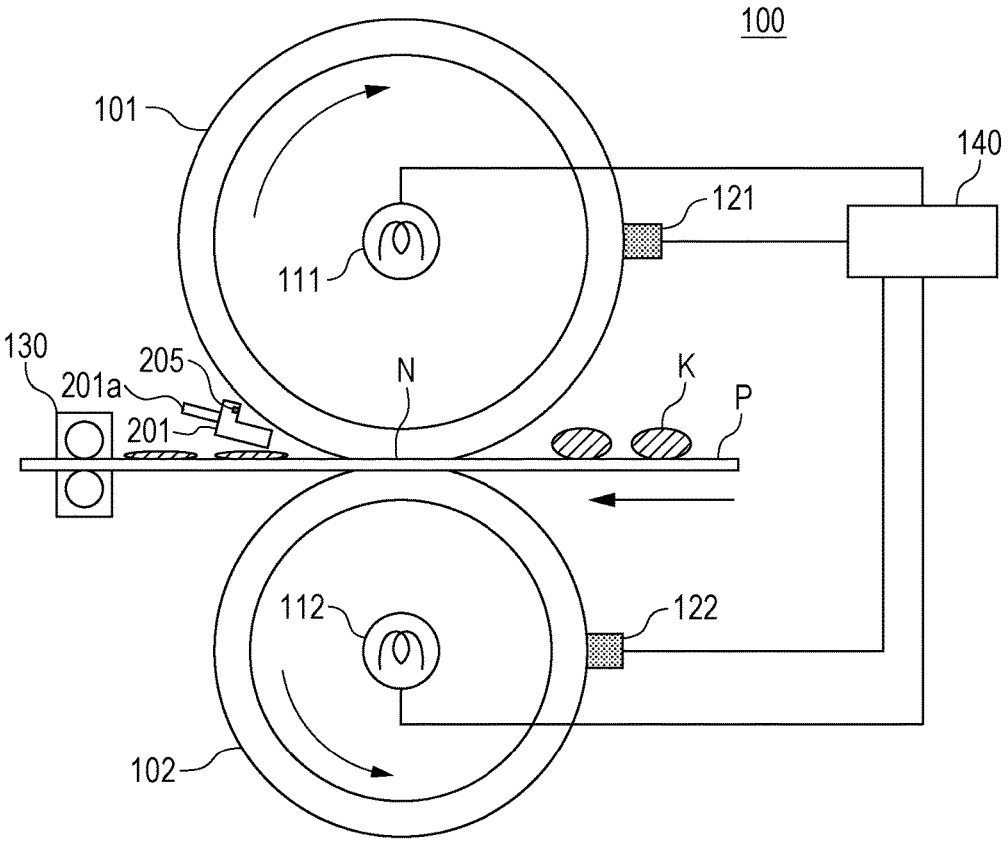
FIG. 4 is a schematic diagram showing the configuration of an air-separating mechanism.

Next, the fixing device 100 will be described. As shown in FIG. 4, the fixing device 100 includes a fixing roller 101, serving as a fixing member, and a pressure roller 102, serving as a pressure member. The fixing roller 101 is rotationally driven by a driving source (not shown) in the direction indicated by the arrow, at a predetermined speed, for example, at a circumferential speed of 300 mm/s (70 pages per minute (ppm) with an A4 sheet in the landscape orientation). The pressure roller 102 is rotated in a driven manner by the rotation of the fixing roller 101.

The fixing roller 101 and the pressure roller 102 are each formed of a cylindrical core metal, a heat-proof elastic layer, and a heat-proof releasing layer that are sequentially stacked from inside.

The core metal of the fixing roller 101 has, for example, an outside diameter of 76 mm, a thickness of 6 mm, and a length of 350 mm, and is made of aluminum. The elastic layer is made of silicone rubber (e.g., a JIS-A hardness of 20 degrees) having a thickness of, for example, 2 mm and covers the outer circumferential surface of the core metal. The heat-proof releasing layer is formed of fluoroplastic (for example, a PFA tube) having a thickness of, for example, 100 μm to improve the releasability from toner and covers the surface of the elastic layer.

The core metal of the pressure roller 102 has, for example, an outside diameter of 54 mm, a thickness of 5 mm, and a length of 350 mm and is made of stainless steel. In order to prevent deflection, stainless steel, which has a higher rigidity than aluminum, is used for the pressure roller. The elastic layer is made of silicone rubber (e.g., a JIS-A hardness of 24 degrees) having a thickness of, for example, 3 mm and covers the outer circumferential surface of the core metal. Furthermore, the heat-proof releasing layer is made of fluoroplastic (for example, a PFA tube) having a thickness of, for example, 100 μm to improve the releasability from toner and covers the surface of the elastic layer.

Furthermore, as shown in FIG. 4, a halogen heater 111 having a rated power of, for example, 1500 W, which serves as a heat source and generates heat by energization, is provided inside the core metal of the fixing roller 101 so as to extend over substantially the entirety of the fixing roller 101 in the width direction (i.e., the longitudinal direction and the axial direction). The halogen heater 111 heats the fixing roller 101 from inside such that the surface temperature thereof reaches a predetermined target temperature. The surface temperature of the fixing roller 101 is detected by a thermistor 121, serving as a temperature detection unit, provided in a recording-medium passing area. Then, a CPU 140, serving as a heater control unit, performs ON/OFF control on the fixing heater 111, on the basis of the temperature detected by the thermistor 121. As a result, the temperature of the fixing heater 111 is controlled at a predetermined target temperature, for example, 180° C.

As shown in FIG. 4, a halogen heater 112 having a rated power of, for example, 400 W, which serves as a heat source and generates heat by energization, is provided inside the core metal of the pressure roller 102 so as to extend over substantially entirety of the pressure roller 102 in the width direction (i.e., the longitudinal direction and the axial direction). The halogen heater 112 heats the pressure roller 102 from inside such that the surface temperature thereof reaches a predetermined target temperature. The surface temperature of the pressure roller 102 is detected by a thermistor 122, serving as a temperature detection unit, provided in the recording-medium passing area. Then, the CPU 140, serving as the heater control unit, performs ON/OFF control on the pressure heater 112, on the basis of the temperature detected by the thermistor 122. In this way, the temperature of the pressure heater 112 is controlled at a predetermined target temperature, for example, 100° C.

The pressure roller 102 is pressed against the fixing roller 101 at a predetermined pressure by a pressure applying unit (not shown), forming a fixing nip portion N, which is a pressure contact portion with respect to the fixing roller 101, and is rotated in a driven manner by the fixing roller 101, in the direction indicated by the arrow. The width of the fixing nip portion N in the circumferential direction is about 10 mm. The thermistors 121 and 122 may be either of a contact or a non-contact type with respect to the object to be detected.

The fixing device having the pressure roller 102 and the pressure heater 112 can maintain the surface temperature of the pressure roller 102 at a predetermined temperature during stand-by and printing. Thus, it is possible to ensure substantially constant fixing characteristics from the beginning to the end of printing. Furthermore, because the temperature difference between the surface of the fixing roller 101 and the surface of the pressure roller 102 is small, curling occurring especially in thin paper is small. Herein, the fixing characteristics mean the adhesion between the recording medium P and the toner K.

The thus-configured fixing roller 101 and pressure roller 102 of the fixing device 100 are separated from each other and urged against each other during stand-by and during printing. These separating and urging operations will be described below.

During stand-by, the pressure roller 102 is separated from the fixing roller 101 by a separating unit (not shown) to prevent deformation or strain of the elastic layers of the fixing roller 101 and pressure roller 102.

On the other hand, during printing, that is, while an image on a recording medium is being fixed (pressed and heated), the pressure roller 102 is urged against the fixing roller 101 by the pressure applying unit (not shown). If, during stand-by, the fixing roller 101 and the pressure roller 102 are kept urged against each other without being separated, deformation or strain of the elastic layers of the rollers may remain at the fixing nip portion N during printing, producing horizontal streaks, gloss streaks (uneven gloss), etc., on the image and degrading the image quality. Therefore, the configuration as in this embodiment, in which the rollers are separated during stand-by and are urged against each other during printing, is desirable.

The fixing device 100 fixes a toner K image formed on a recording medium P at the image forming portion to the recording medium P. Specifically, as shown in FIG. 4, the recording medium P carrying the toner K is conveyed in the direction indicated by the arrow and is guided to the fixing nip portion N. The recording medium P is heated and pressed as it passes through the fixing nip portion N, and thus, the toner K is fixed on the recording medium P.

The recording medium P having the toner fixed thereto at the fixing nip portion N is separated from the fixing roller 101 by a blowing member 201 that blows air between the recording medium P and the fixing roller 101, and is output from the image forming apparatus.

Air-Separating Mechanism

Figure 8:
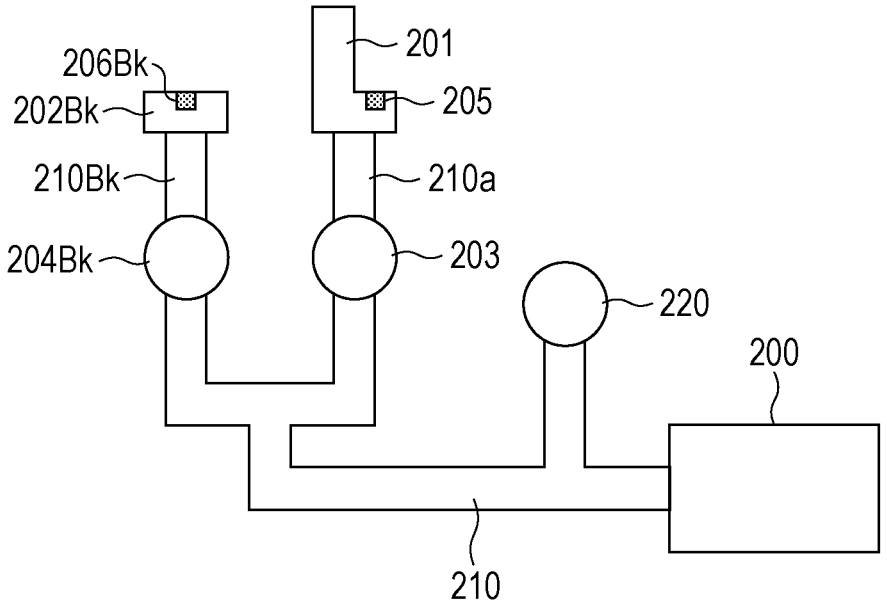
FIG. 8 is a schematic diagram showing the configuration of the air-separating mechanism and the air-cleaning mechanism in the monochrome image forming apparatus.

Next, an air-separating mechanism will be described. FIG. 8 is a schematic diagram showing an air-separating mechanism of the monochrome image forming apparatus. As shown in FIG. 8, an air hose 210 leading out of a compressed-air generating device (air pump) 200, serving as a compressor, is split into an air hose 210*a* and an air hose 210Bk (described below), and the air hose 210*a* is connected to the blowing member 201, serving as a nozzle portion.

A valve 203, serving as an air opening-and-closing valve (solenoid valve), is connected to the blowing member 201 via the air hose 210*a*. Blowing of air and stopping of air blow by the blowing member 201 are controlled by opening and closing of the valve 203.

In order to prevent the air pressure in the air hose 210 exceeding a predetermined value due to, after the air pump 200 is turned on, the valve 203 and the valve 204Bk being closed, an air-pressure adjusting valve 220 is disposed in the air hose 210, whereby the air pressure in the air hose 210 is maintained at a predetermined value.

Figure 5:
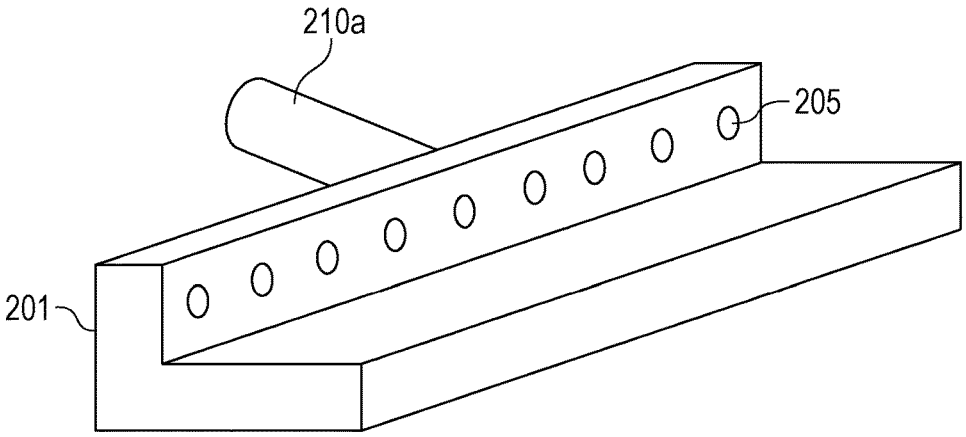
FIG. 5 is a schematic diagram showing the configuration of the air-separating mechanism.

As shown in FIG. 5, the blowing member 201 is configured to blow air at the fixing roller 101, which is one of the rotatable members constituting the fixing portion. The blowing member 201 extends in the longitudinal direction of the fixing roller 101 so as to cover the maximum recording-medium passing area, has an L-shaped section, and has air outlets 205 having a predetermined diameter (in this embodiment, 1 mm) and arranged at predetermined intervals in the longitudinal direction (in this embodiment, 34 air outlets 205 are arranged at an interval of 10 mm). In this embodiment, the maximum width of recording media is 13 inches (approx. 330 mm). The plurality of air outlets 205 are connected to the air hose 210*a*, which is connected to the rear face of the blowing member 201.

As shown in FIG. 4, the blowing member 201 is disposed as close to the fixing nip portion N as possible, without touching the fixing roller 101, and hence, it is disposed such that the open side of the L shape faces the fixing roller 101. Furthermore, as shown in FIG. 4, the blowing member 201 is disposed such that the longitudinal-axis side of the L shape is located on the recording-medium conveying side, whereby it can also serve as a separator plate for separating the recording medium P from the fixing roller 101.

Air-Cleaning Mechanism

Figure 6:
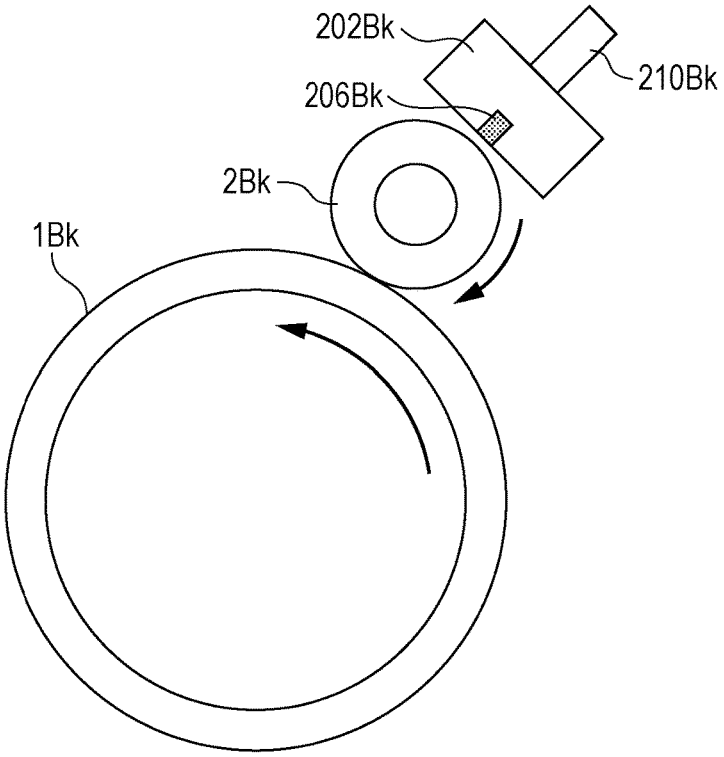
FIG. 6 is a schematic diagram showing the configuration of an image forming portion including a charging roller.

Next, an air-cleaning mechanism will be described. FIG. 6 is an example in which the charging roller, which is one of the plurality of devices constituting the image forming portion, is cleaned. As shown in FIG. 6, the charging roller 2Bk, serving as a charging portion, that is in contact with the photosensitive drum 1Bk and is rotated in a driven manner, and a blowing member 202Bk, serving as a nozzle portion, for blowing air at the charging roller 2Bk for cleaning are disposed.

FIG. 8 is a schematic diagram showing an air pump of the monochrome image forming apparatus. FIG. 8 shows an example in which the charging roller is cleaned by utilizing the compressed-air generating device (air pump) 200 provided for the air-separating mechanism. The air hose 210 leading out of the compressed-air generating device (air pump) 200 is split into the air hose 210*a* and the air hose 210Bk, and the air hose 210Bk is connected to the blowing member 202Bk, serving as the air-cleaning mechanism.

A valve 204Bk, serving as an air opening-and-closing valve (solenoid valve), is connected to the blowing member 202Bk via the air hose 210Bk. Blowing of air and stopping of air blow at the blowing member 202Bk is controlled by opening and closing the valve 204Bk.

Figure 7:
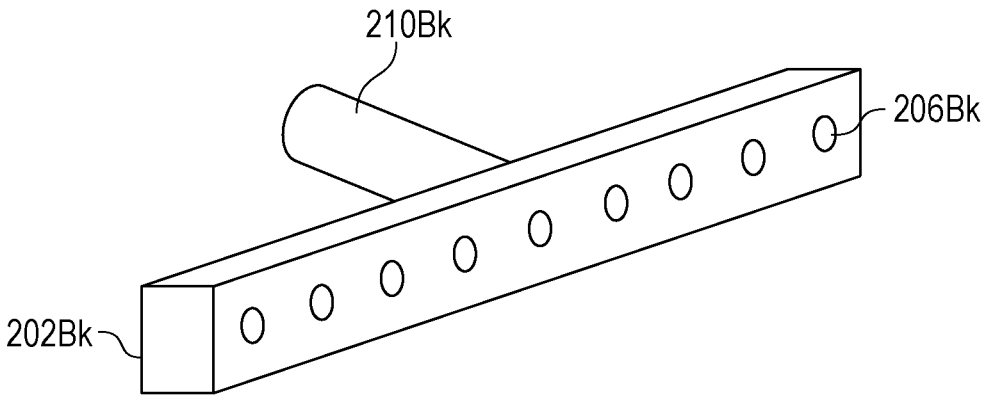
FIG. 7 is a schematic diagram showing the configuration of an air-cleaning mechanism.

As shown in FIG. 7, the blowing member 202Bk extends in the longitudinal direction so as to be able to blow air at the entire area, in the longitudinal direction, of the charging roller 2Bk and has air outlets 206Bk having a predetermined diameter (in this embodiment, 1 mm) and arranged at predetermined intervals in the longitudinal direction (in this embodiment, 36 air outlets 206Bk are arranged at an interval of 10 mm). Because the maximum width of recording media in this embodiment is 13 inches (approx. 330 mm), the charging roller has a width of 350 mm. The plurality of air outlets 206Bk are connected to the air hose 210Bk, which is connected to the rear face of the blowing member 202Bk.

As shown in FIG. 6, the blowing member 202Bk is disposed as close to the charging roller 2Bk as possible, without touching the charging roller 2Bk. The appropriate distance between the surface of the charging roller 2Bk and the air outlets 206Bk is about 1 to 2 mm. If this distance is too large, the air pressure for cleaning (blowing off) the substance adhered to the charging roller is low, and the air cleaning performance is low, whereas if this distance is too small, only the adhering substance adhered to the surface facing the air outlets 206Bk of the charging roller 2Bk is cleaned, and cleaning cannot be performed evenly. Hence, it is desirable that the distance be set such that a certain area near the outlets 206Bk can be cleaned.

Furthermore, as shown in FIG. 6, during air cleaning of the charging roller 2Bk, the entire circumference of the charging roller 2Bk can be cleaned by rotating the charging roller 2Bk. Hence, it is desirable to rotate the photosensitive drum 1Bk.

Air-Blowing Timing

Next, using FIGS. 10A and 10B, the air-blowing timing in the air separating and air cleaning operations in the air pump configuration of the monochrome image forming apparatus shown in FIG. 8 will be described.

Figure 10A:
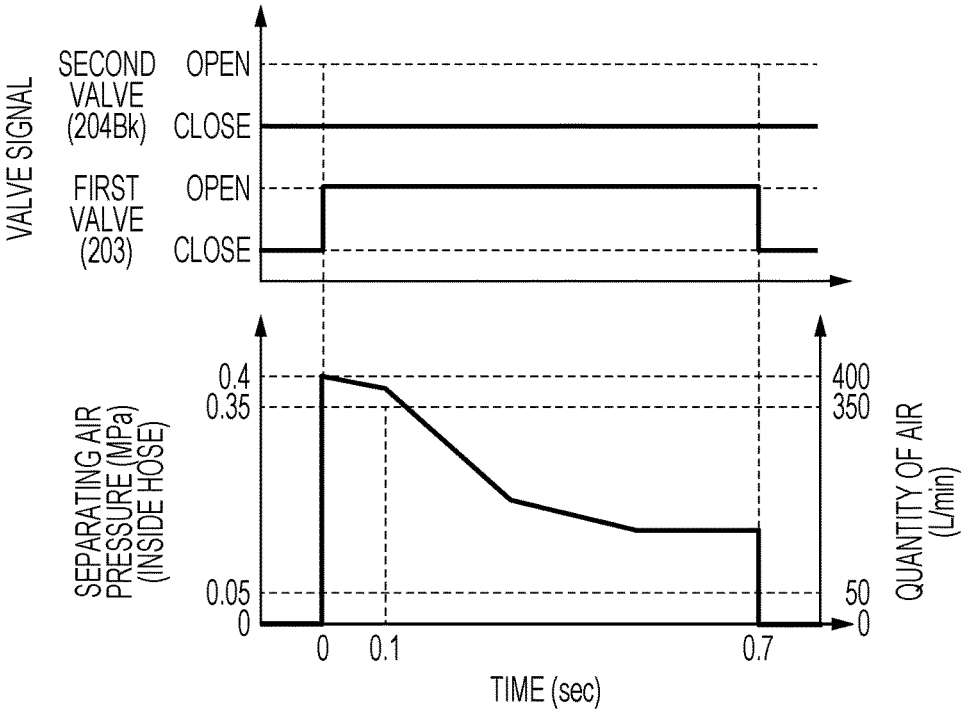
FIGS. 10A and 10B schematically show changes, with time, in the air pressure and the quantity of air in the air-separating mechanism.

FIG. 10A shows the air-blowing timing at the blowing member 201 (valve 203 opening and closing timing), the separating air pressure (left vertical axis: the air pressure in the air hose 210*a*), and the quantity of air (right vertical axis: the quantity of air in the air hose 210*a*) when the first valve (valve 203) is open and the second valve (valve 204Bk) is closed.

Herein, the air pressure and the quantity of air are measured in the air hose 210*a*.

Assuming that the time at which the leading end of a recording medium P is discharged from the fixing nip portion N is 0 second when an A4 size sheet in the landscape orientation (width: 297 mm, length: 210 mm) is supplied, the time at which the trailing end of the recording medium is discharged from the fixing nip portion N is 0.7 seconds (because the sheet moves at 300 mm/s, a sheet with a length of 210 mm moves in 700 ms).

A separation fault of a recording medium occurs due to adhesion between the toner K and the fixing roller 101, which is caused by melting of toner.

As shown in FIG. 10A, after the leading end of the recording medium P is discharged from the exit of the fixing nip portion N and before the leading end reaches the blowing member 201, including the tolerance, the first valve (203) is opened to blow air between the leading end of the recording medium P and the fixing roller 101. By maintaining the air pressure and the quantity of air needed to separate the leading end of the recording medium P from the fixing roller 101 for a duration of time sufficient to separate the leading end of the recording medium P from the fixing roller 101, the recording medium P is separated from the fixing roller 101.

Herein, in order for the blowing member 201 to separate the recording medium P from the fixing roller 101, it is desirable that the air pressure be maintained at 0.35 (MPa) or more and the quantity of air be maintained at 350 (L/min) or more for 0.1 second from the start of blowing of air. In FIG. 10A, these values are satisfied. Hence, in FIG. 10A, a separation fault of recording medium P does not occur, and the recording media P can be appropriately separated.

Thereafter, while the recording medium P passes through the fixing nip portion N, the air is kept blown, and, immediately after the trailing end of the recording medium P exits the fixing nip portion N, the first valve (203) is closed to stop blowing of air. In the intervals between recording media, blowing of air is stopped to increase the air pressure and the quantity of air, so that air at the required pressure and of the required quantity can be blown at the leading end of the next recording medium P.

The distance between the recording media in this embodiment is about 47.2 mm (about 157 ms). With an air-blowing stop time of about 150 ms, the air pressure and the quantity of air shown in FIG. 10A can be obtained in the subsequent blowing of air.

When the leading end of the next recording medium P is discharged from the fixing nip portion N, the first valve (203) is opened, and the blowing member 201 blows air at the pressure and of the quantity sufficient to separate the recording medium P from the fixing roller 101. This process is repeated, and recording media P are separated during printing.

Herein, as shown in FIG. 10A, the air pressure and the quantity of air blown by the air separating unit decreases from the leading end of the recording medium P toward the trailing end thereof.

The leading end of the recording medium P is separated from the fixing roller 101 and is conveyed while being nipped by the discharge roller pair 130 shown in FIG. 4. Typically, by making the circumferential speed of the discharge roller pair 130 higher than that of the fixing roller 101, the recording medium discharged from the fixing nip portion N is pulled, preventing the recording medium P from loosening between the fixing nip portion N and the discharge roller pair 130.

Accordingly, once the leading end of the recording medium P reaches the discharge roller pair 130, even if blowing of air from the blowing member 201 is stopped, a separation fault does not occur, and the recording medium is not wrapped around the fixing roller 101. Therefore, after the leading end of the recording medium P is discharged from the fixing nip portion N and reaches the discharge roller pair 130, blowing of air from the blowing member 201 may be stopped. Therefore, when the sheet interval time is shorter than the air-blowing stop time needed to recover the air pressure and the quantity of air, blowing of air from the blowing member 201 may be stopped before the trailing end of the recording medium P exits the fixing nip portion N, as long as the leading end of the recording medium P has reached the discharge roller pair 130.

In this embodiment, the discharge roller pair 130 is disposed at about 60 mm from the exit of the fixing nip portion N. Hence, in FIG. 10A, blowing of air may be stopped after about 0.3 seconds, which includes the time for the discharge roller pair 130 to start pulling the recording medium P.

A separation fault occurs not only at the leading end of a recording medium P. A recording medium P may be wrapped around the fixing roller 101 at an intermediate part thereof, and this problem is called "intermediate wrapping". In this case, it is desirable that the air be discharged until the trailing end of the recording medium P exits the fixing nip portion N. However, the air pressure and the quantity of air needed to prevent the intermediate wrapping is far smaller than the air pressure and the quantity of air needed to prevent a separation fault of the leading end of the recording medium P. Specifically, the intermediate wrapping can be prevented with an air pressure of 0.05 (MPa) or more and a quantity of air of 50 (L/min) or more. In FIG. 10A, the air pressure and the quantity of air with which the intermediate wrapping can be prevented are satisfied. Thus, although blowing of air may be stopped after the elapse of 0.3 seconds, in this embodiment, it is configured that blowing of air is continued until the trailing end of the recording medium P exits the fixing nip portion N.

Figure 10B:
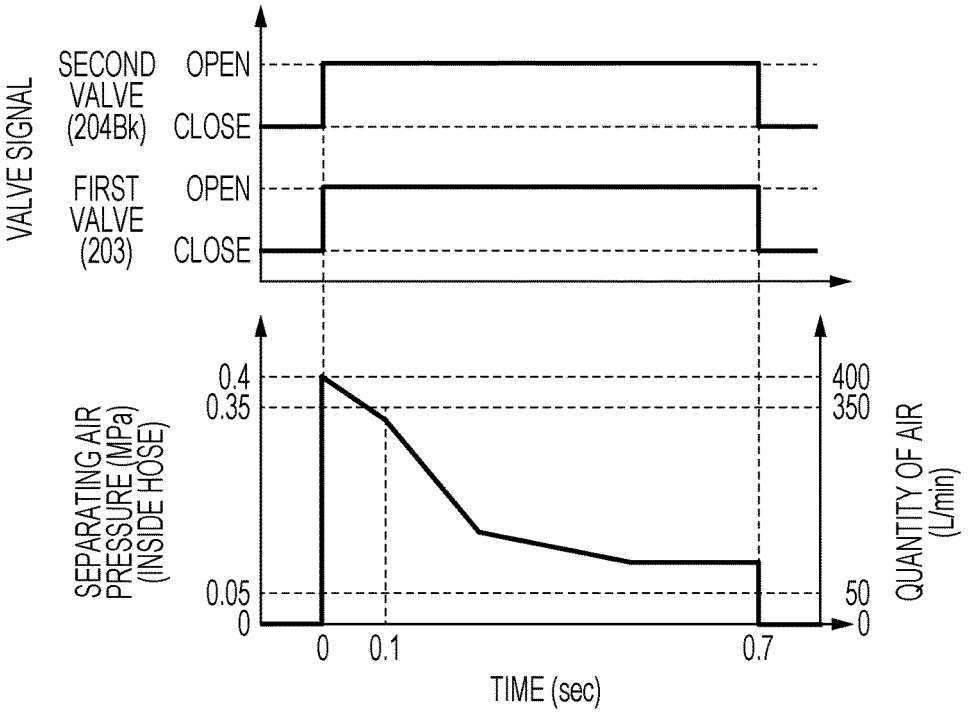

Next, FIG. 10B shows the air-blowing timing at the blowing member 201 (valve 203 opening and closing timing), the separating air pressure (left vertical axis: the air pressure inside the air hose 210*a*), and the quantity of air (right vertical axis: the quantity of air in the air hose 210*a*) when the first valve (valve 203) is open and the second valve (valve 204Bk) is open.

It has been described that, in order for the blowing member 201 to separate the recording medium P from the fixing roller 101, it is desirable that the air pressure be maintained at 0.35 (MPa) or more and the quantity of air be maintained at 350 (L/min) or more for 0.1 second from the start of blowing of air. However, in FIG. 10B, these values are satisfied, and a separation fault of a recording medium P may occur.

The reason for this is that, in FIG. 10B, the second valve (204Bk) is opened so that air cleaning is performed simultaneously with air separating. In this case, decreases with time in the air pressure and the quantity of air are accelerated compared with the case of FIG. 10A, where only air separating is performed.

Accordingly, in FIG. 10B, at the point of 0.1 second, the air pressure and the quantity of air are less than 0.35 (MPa) and 350 (L/min), respectively, making a separation fault easy to occur.

Hence, it has turned out that, to perform stable air separating, air separating and air cleaning cannot be performed simultaneously. Accordingly, as shown in FIG. 10A, it is desirable that air cleaning be not performed, that is, the second valve be closed (204Bk) when air separating is performed, that is, when the first valve (203) is open.

Figure 9:
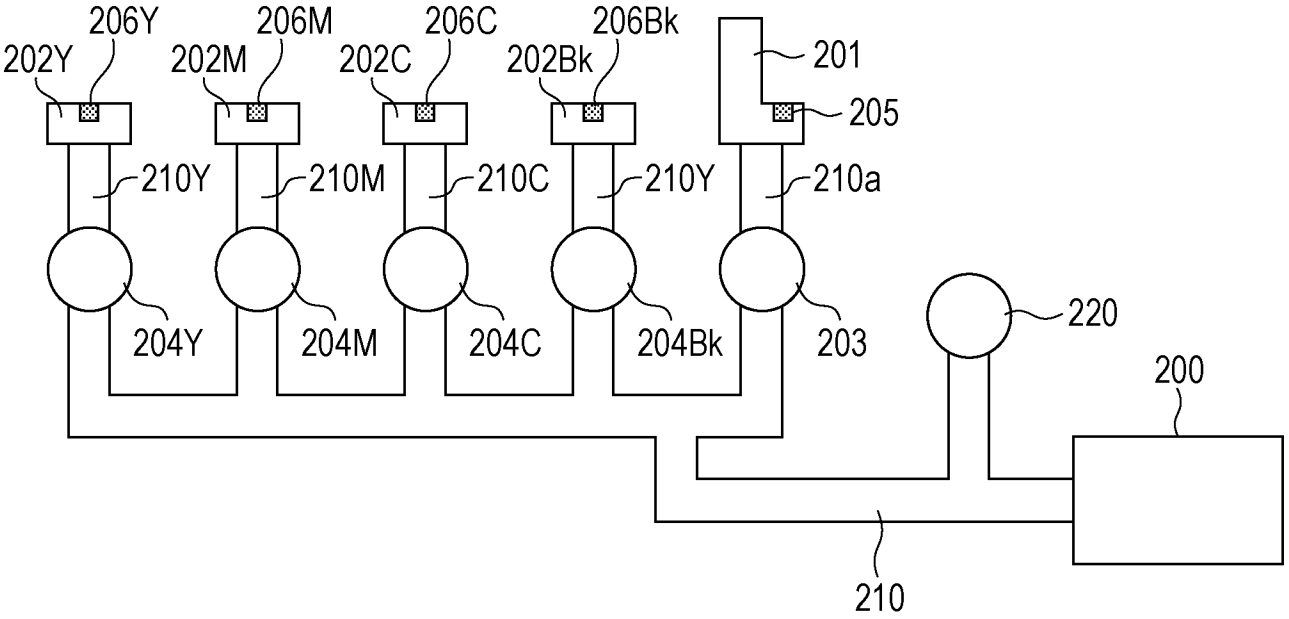
FIG. 9 is a schematic diagram showing the configuration of the air-separating mechanism and the air-cleaning mechanism in the color image forming apparatus.

Although the air pump configuration of the monochrome image forming apparatus shown in FIG. 8 has been described above, the air pump configuration of the color image forming apparatus shown in FIG. 9 is the same.

FIG. 9 shows the air pump configuration of the color image forming apparatus. Because the color image forming apparatus shown in FIG. 2 has four charging rollers, there are four air cleaning units (202Bk, 202C, 202M, and 202Y). Hence, there are air outlets 206Bk, 206C, 206M, and 206Y; air hoses 210Bk, 210C, 210M, and 210Y; and valves 204Bk, 204C, 204M, and 204Y, serving as air opening-and-closing valves (solenoid valves).

During an air-separating operation, that is, when the first valve (203) is open, it is desirable that air cleaning be not performed, that is, the second valve (204Bk), the third valve (204C), the fourth valve (204M), and the fifth valve (204Y) be closed.

A separation fault tends to occur in a high-humidity environment or with recording media having a small basis weight (i.e., thin paper), that is, recording media having low stiffness. On the other hand, a separation fault is less likely to occur in a low-humidity environment or with recording media having a large basis weight (i.e., thick paper), that is, recording media having high stiffness. Hence, for example, in a low-humidity environment or when thick paper is used, air does not need to be blown for separation, and the air pump may be stopped.

The detection of whether the humidity is high or low may be performed by, for example, detecting the temperature and the humidity with an environmental temperature and humidity detection unit (not shown) provided in an image forming apparatus body and calculating the water content in the environment. For example, in an environment in which the water content is 8 (g/(DRY AIR) Kg) or more, a recording medium absorbs moisture and decreases in stiffness, making a separation fault easy to occur. Thus, air is blown to separate the recording medium P. When the water content is less than 8 (g/(DRY AIR) Kg), a recording medium does not absorb moisture and does not decrease in stiffness, so, the separation fault is less likely to occur. Hence, air does not need to be blown for separation, and the air pump may be stopped.

When the basis weight of a recording medium is less than or equal to a predetermined value, for example, 105 ($g/m^2$), the stiffness is low, and a separation fault tends to occur. Thus, separation air is blown to separate the recording medium. On the other hand, when the basis weight of a recording medium is less than 105 ($g/m^2$), the stiffness is high, and a separation fault is less likely to occur. Thus, the separation air is not blown, and the air pump is stopped.

By setting the sheet size and the basis weight of sheets via a monitor (not shown) of the image forming apparatus when the sheets are set in the image forming apparatus, the image forming apparatus can recognize the width and basis weight of the sheets.

Second Embodiment

A second embodiment of the present invention will be described below, using FIGS. 11A and 11B. In the first embodiment, the configuration in which the blowing members 202Bk, 202C, 202M, and 202Y are not operated while the blowing member 201 is operated has been described. In this embodiment, air cleaning will be described in detail.

In the air pump configuration of the monochrome image forming apparatus shown in FIG. 8, the blowing member 202Bk is not operated while the blowing member 201 is operated, that is, while an image-forming operation is performed.

Thus, the blowing member 202Bk is operated while an image-forming operation is not performed. This time includes start-up of the image forming apparatus (warm-up of the fixing device), stand-by, pre-rotation before image formation, and post rotation after image formation, and air cleaning of the charging roller 2Bk is desirably performed in this time.

If air cleaning of the charging roller 2Bk is performed while an image-forming operation is performed, the toner image on the photosensitive drum 1Bk is damaged by the air. Hence, it is desirable that air cleaning be performed while an image-forming operation is not performed.

Furthermore, it is more desirable that the charging roller 2Bk be rotated during air cleaning, because, by doing so, the entire area thereof in the circumferential direction can be cleaned. However, in order to rotate the charging roller 2Bk, the photosensitive drum 1Bk needs to be rotated, and in such a case, it is desirable that the electric potential of the photosensitive drum 1Bk be adjusted so that the toner does not transfer from the developing device 4Bk to the photosensitive drum 1Bk (so that an image is not developed by the toner). More specifically, it is desirable that a predetermined bias be applied to the charging roller 2Bk such that the photosensitive drum 1Bk has a predetermined electric potential. Furthermore, it is desirable that the developing bias be turned off or a predetermined bias be applied, so that the toner does not transfer from the developing device 4Bk to the photosensitive drum 1Bk.

For example, when the toner is negatively charged, a bias is applied to the charging roller 2Bk such that the photosensitive drum 1Bk is charged at about −400V, the developing bias is turned off (0 V), and the rotation of the developing roller is stopped. It is desirable that air cleaning of the charging roller 2Bk be performed while rotating the photosensitive drum 1Bk with the above-described electric potential setting, rotating the charging roller 2Bk in a driven manner by the photosensitive drum 1Bk, opening the valve 204Bk, and closing the valve 203 as the image-forming operation is not performed.

Substances, such as paper dust, toner, and external additives to the toner, adhered to the charging roller 2Bk are blown off by air, are adhered to the photosensitive drum 1Bk, and are collected by the photosensitive-drum cleaning device 6Bk.

Also in the air pump configuration of the color image forming apparatus shown in FIG. 9, it has been described that the blowing members 202Bk, 202C, 202M, and 202Y are not operated while the blowing member 201 is operated, that is, while an image-forming operation is performed.

Also in the color image forming apparatus, similarly to the above-described monochrome image forming apparatus, air cleaning is performed while an image-forming operation is not performed, and the electric potentials of the photosensitive drums are adjusted.

Herein, when air cleaning is performed, it is desirable that the blowing members 202Bk, 202C, 202M, and 202Y be cleaned one-by-one in sequence. More specifically, it is desirable that the valves 204Bk, 204C, 204M, and 204Y shown in FIG. 9 be opened one-by-one in sequence, not simultaneously, and the charging rollers be air-cleaned one-by-one. This is because, if a plurality of valves are opened to clean a plurality of charging rollers simultaneously, the air pressure and the quantity of air from the air cleaning unit decrease, leading to a decrease in the air cleaning performance.

Figure 11A:
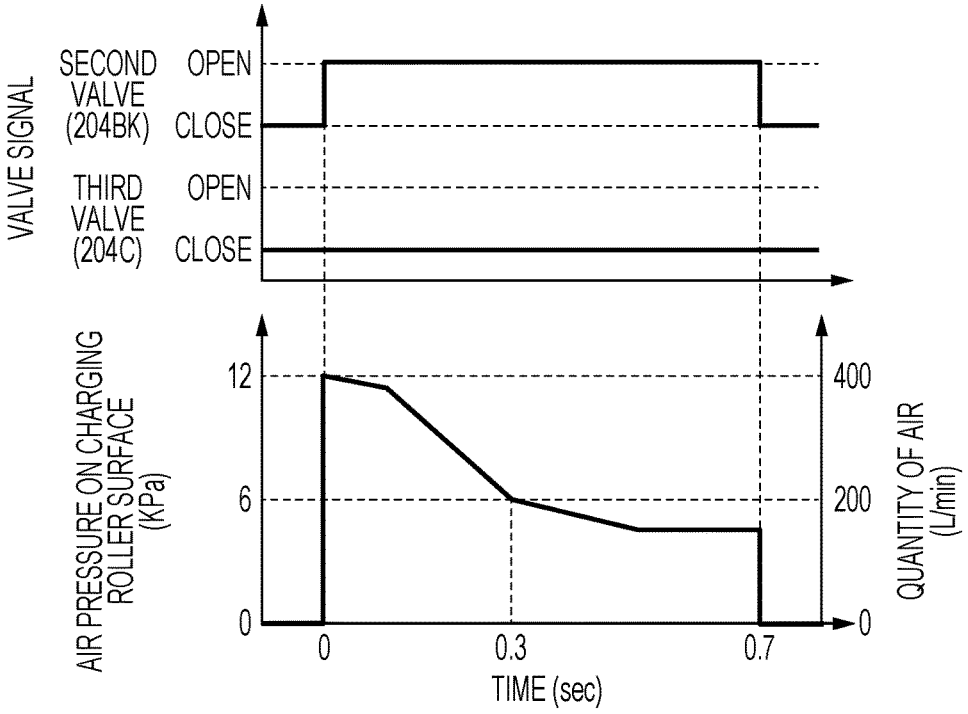
FIGS. 11A and 11B schematically show changes, with time, in the air pressure and the quantity of air in the air-cleaning mechanism.

FIG. 11A shows, in the air pump configuration of the color image forming apparatus shown in FIG. 9, the air-blowing timing at the blowing member 202Bk (valve 204Bk opening and closing timing), the cleaning air pressure (left vertical axis: the air pressure at the charging roller surface), and the quantity of air (right vertical axis: the quantity of air in the air hose 210Bk) when the second valve (valve 204Bk) is open, the third valve (valve 204C) is closed, the fourth valve (valve 204M) and the fifth valve (204Y) are closed.

Herein, the air pressure is measured at the charging roller surface and the quantity of air is measured in the air hose 210Bk.

For the blowing members 202Bk, 202C, 202M, and 202Y to clean the charging rollers, it has been turned out that, as a result of study, it is desirable that the air pressure be maintained at 6 (KPa) or more and the quantity of air be maintained at 200 (L/min) or more. In FIG. 11A, these values are satisfied for about 0.3 seconds after the start of blowing of air.

Accordingly, as in FIG. 11A, when one air cleaning unit is operated, the charging roller may be cleaned for about 0.3 seconds after the start of blowing of air. Although the air may be blown at the charging roller for more than 0.3 seconds, it would provide no advantage because the adhering substance electrostatically and mechanically adhered to the charging roller cannot be blown off with an air pressure of 6 (KPa) or less.

Figure 11B:
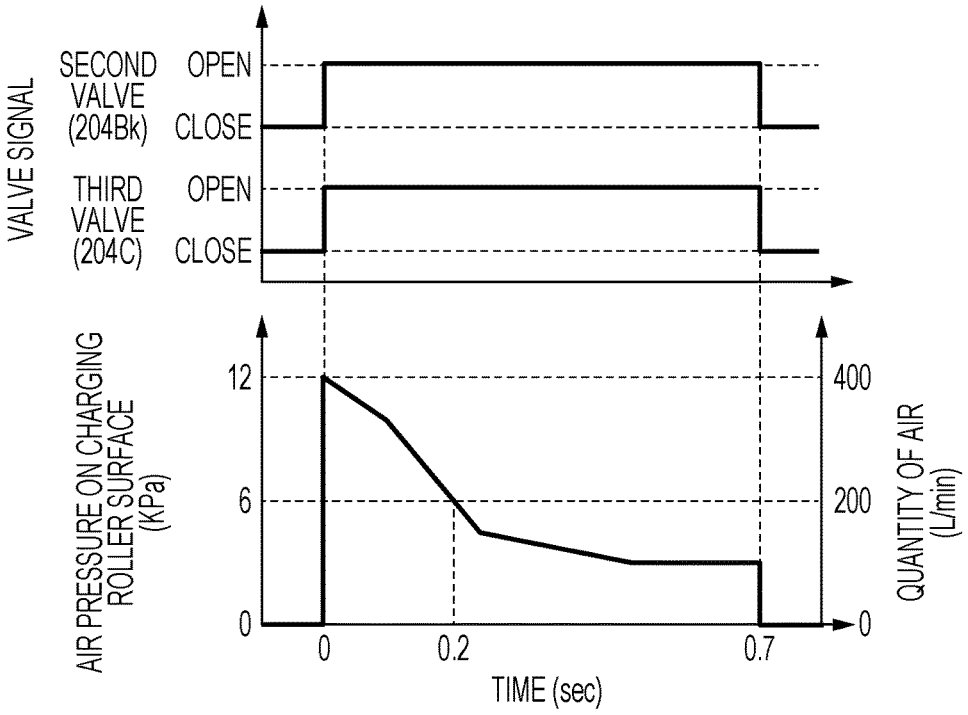

FIG. 11B shows, in the air pump configuration of the color image forming apparatus in FIG. 9, the air-blowing timing at the blowing member 202Bk (valve 204Bk opening and closing timing), the cleaning air pressure (left vertical axis: the air pressure at the charging roller surface), and the quantity of air (right vertical axis: the quantity of air inside the air hose 210Bk) when the second valve (valve 204Bk) is open, the third valve (valve 204C) is open, the fourth valve (valve 204M) and the fifth valve (204Y) are closed.

In FIG. 11B, an air pressure of 6 (KPa) or more and a quantity of air of 200 (L/min) or more, which are required for air cleaning of the charging roller, are satisfied for about 0.2 seconds after the start of blowing of air.

Accordingly, as in FIG. 11B, when two air cleaning units are operated, the charging rollers may be cleaned for about 0.2 seconds after the start of blowing of air.

With the configuration in FIG. 11B, the time for which the air pressure and the quantity of air required for air cleaning are maintained is shorter than that in FIG. 11A. Furthermore, when three or four air cleaning units are simultaneously operated, this time becomes even shorter, and the cleaning performance decreases. Therefore, as has been described above, it is desirable that the charging rollers of the color image forming apparatus be air-cleaned one-by-one in sequence, at predetermined time intervals, for example, 0.5 seconds. By doing so, air cleaning can be performed while maintaining high cleaning performance.

Third Embodiment

A third embodiment of the present invention will be described, using FIG. 12. When air cleaning is performed on the charging roller, the photosensitive drum is rotated so as to perform air cleaning while rotating the charging roller. At this time, it is desirable that the photosensitive drum be maintained at a predetermined electric potential so that toner does not adhere to the photosensitive drum. Thus, as described above, a predetermined bias is applied to the charging roller.

At this time, if the blowing members 202Bk, 202C, 202M, and 202Y are formed of an insulating material, there is no problem. However, if the blowing members 202Bk, 202C, 202M, and 202Y are formed of an electro-conductive material, there is a problem such as leakage of a charging-roller bias and toner smudge occurring at the air cleaning units.

Figure 12:
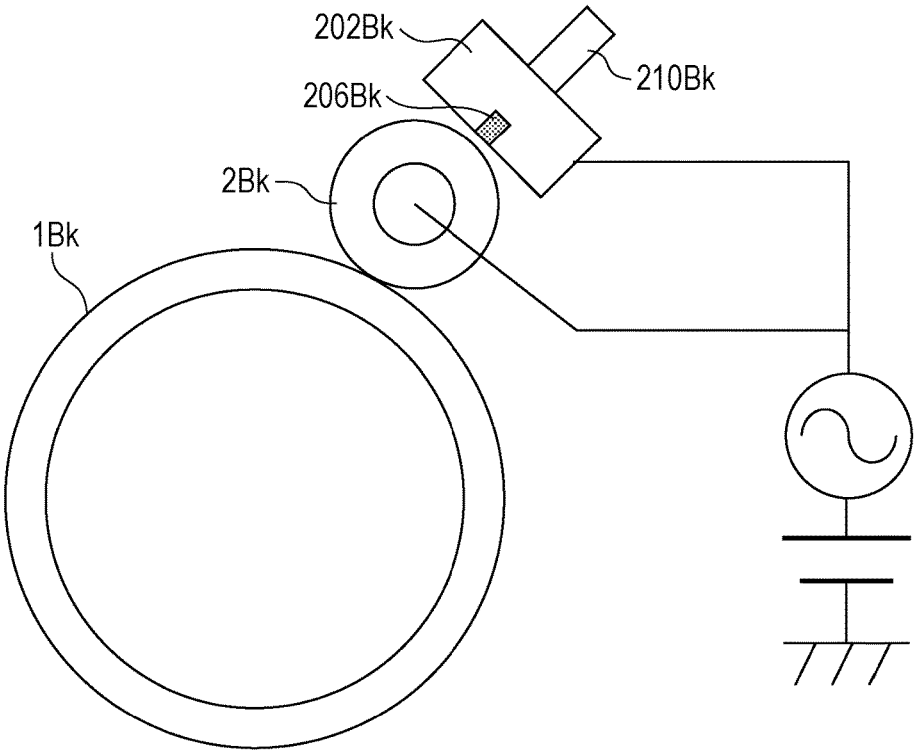
FIG. 12 is a schematic diagram showing the configuration of a bias applied to the air-cleaning mechanism.

Accordingly, when the air cleaning unit is formed of an electro-conductive material, as shown in FIG. 12 with an example of Bk, it is desirable that the bias to be applied to the charging roller 2Bk be also applied to the blowing member 202Bk, which is adjacent to the charging roller 2Bk.

Herein, in FIG. 12, although the bias applied to the charging roller 2Bk is an AC voltage superimposed on a negative DC voltage so that the photosensitive drum 1Bk is uniformly charged, depending on the image forming apparatus, only a DC voltage may be applied.

By doing so, the electric potentials of the air cleaning unit and the charging roller become equal, eliminating leakage and noise, and reducing the amount of attached toner. Hence, the necessity of periodic cleaning of the blowing member 202Bk can be reduced.

Fourth Embodiment

A fourth embodiment of the present invention will be described, using FIG. 13. As shown in FIG. 11A, it has been described that the duration of time for which an air pressure of 6 (KPa) or more and a quantity of air of 200 (L/min) or more, which are needed for air cleaning of the charging roller, can be maintained is about 0.3 seconds after the start of blowing of air, even when the charging rollers are cleaned one-by-one in sequence.

In this embodiment, a more effective air cleaning method is proposed. In this embodiment, as shown in FIG. 13, by alternately switching a 0.3 seconds of ON and a 0.15 seconds of OFF, air cleaning of the charging roller can be more effectively performed.

Figure 13:
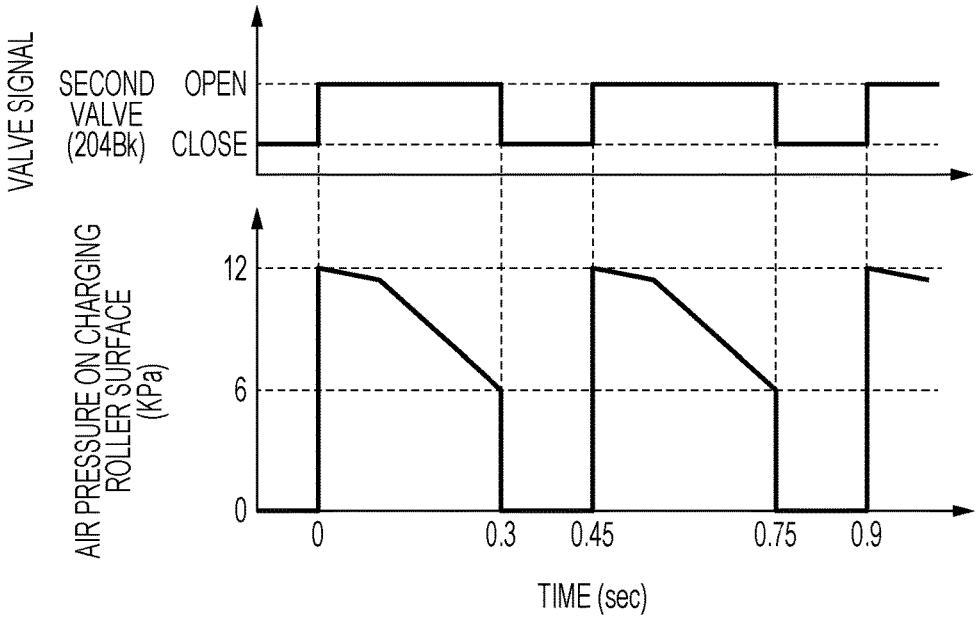
FIG. 13 schematically shows air-blowing timing in the air-cleaning mechanism.

As shown in FIG. 13, after the elapse of 0.3 seconds from the start of blowing of air, the air pressure and the quantity of air decrease, and the air cleaning performance for cleaning the charging roller decreases significantly. Hence, during air cleaning, blowing of air is performed for a duration of time for which an air pressure of 6 (KPa) or more and a quantity of air of 200 (L/min) or more can be maintained. A 0.15 seconds of OFF is the time needed for the air pressure and the quantity of air to return to the initial states.

For example, in the case of the color image forming apparatus, while an image forming operation is not performed, intermittent air cleaning, as shown in FIG. 13, is performed ten times, i.e., for 4.5 seconds, on one charging roller and then is performed for 4.5 seconds on the next charging roller. By sequentially performing the intermittent air cleaning in this manner, air cleaning of the charging rollers can be more effectively performed, and the lives of the charging rollers can be increased.

Although the embodiments of the present invention have been described above, the values and schematic diagrams provided in the descriptions of the embodiments are merely examples for simplifying the explanations, and they may be appropriately determined according to the image forming apparatus, in particular, the configuration of the charging roller and the configuration, setting, etc. of the fixing device.

Furthermore, the present invention may be applied not only to the image forming apparatuses and fixing devices according to the above-described embodiments, but also to image forming apparatuses and fixing devices according to other embodiments, including combinations of the above-described embodiments.

For example, although the fixing member and the pressure member constitute a roller system in the above-described embodiments, the present invention may be applied to a fixing device in which a pressure belt is used as a pressure member to increase the fixing performance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-128204, filed Jun. 26, 2015, which is hereby incorporated by reference herein in its entirety.

What is claimed is:

1. An image forming apparatus comprising:

a photosensitive member;

a charging roller configured to electrically charge said photosensitive member;

an exposing portion configured to expose said photosensitive member charged by said charging roller to form an electric image;

a developing portion configured to develop the electric image by toner to form a toner image;

a transferring portion configured to transfer the toner image to a sheet;

a fixing portion configured to fix the toner image on the sheet;

a compressor configured to generate compressed air;

a first blower configured to blow the compressed air generated by said compressor to said fixing portion to separate the sheet from said fixing portion; and a second blower configured to blow the compressed air generated by said compressor to said charging roller to clean said charging roller.

2. An image forming apparatus according to claim 1, wherein said second blower blows the compressed air intermittently.

3. An image forming apparatus according to claim 1, wherein said fixing portion includes a pair of rotatable members configured to form a fixing nip for fixing the toner image on the sheet, and wherein said first blower blows the compressed air compressed by said compressor to one of said rotatable members to separate the sheet from said fixing portion.

4. An image forming apparatus according to claim 1,
wherein a charging bias is applied to said charging roller, and
wherein a bias having a polarity the same as a polarity of the charging bias is applied to said second blower.

5. An image forming apparatus according to claim 4, wherein said second blower includes a nozzle portion, and
wherein the bias is applied to said nozzle portion.

6. An image forming apparatus according to claim 1,
wherein a charging bias is applied to said charging roller, and
wherein the charging bias is applied to said second blower.

7. An image forming apparatus according to claim 6, wherein the charging bias is an AC voltage superimposed on a DC voltage.

8. An image forming apparatus according to claim 6,
wherein said second blower includes a nozzle portion, and
wherein the charging bias is applied to said nozzle portion.

9. An image forming apparatus according to claim 1, wherein said second blower blows the compressed air compressed by said compressor to said charging roller which is rotating.

10. An image forming apparatus according to claim 1, wherein said second blower is capable of blowing the compressed air to said charging roller with an air pressure at 6 KPa or more to clean said charging roller.

* * * * *